US008493285B2

(12) United States Patent
Kuhn

(10) Patent No.: US 8,493,285 B2
(45) Date of Patent: Jul. 23, 2013

(54) DISPLAY SYSTEM, IN PARTICULAR FOR AN INDUSTRIAL AUTOMATION DEVICE

(75) Inventor: Andreas Kuhn, Chemnitz (DE)

(73) Assignee: Siemens Aktiengesellschaft, München (DE)

( * ) Notice: Subject to any disclaimer, the term of this patent is extended or adjusted under 35 U.S.C. 154(b) by 1210 days.

(21) Appl. No.: 11/991,823

(22) PCT Filed: Aug. 2, 2006

(86) PCT No.: PCT/EP2006/064962

§ 371 (c)(1),
(2), (4) Date: Mar. 11, 2008

(87) PCT Pub. No.: WO2007/031366

PCT Pub. Date: Mar. 22, 2007

(65) Prior Publication Data

US 2009/0091513 A1 Apr. 9, 2009

(30) Foreign Application Priority Data

Sep. 12, 2005 (DE) ..... 10 2005 043 310

(51) Int. Cl.
*G09G 5/00* (2006.01)

(52) U.S. Cl.
USPC ..... 345/4; 345/87

(58) Field of Classification Search
USPC ..... 349/86, 87, 88; 345/4, 5, 6
See application file for complete search history.

(56) References Cited

U.S. PATENT DOCUMENTS

| | | | | |
|---|---|---|---|---|
| 4,768,300 | A | 9/1988 | Rutili | |
| 6,721,023 | B1 * | 4/2004 | Weiss et al. | 349/87 |
| 7,148,499 | B2 * | 12/2006 | Lapstun et al. | 250/566 |
| 2004/0160538 | A1 * | 8/2004 | Li et al. | 349/16 |
| 2004/0257317 | A1 | 12/2004 | O'Keeffe et al. | |
| 2005/0052341 | A1 | 3/2005 | Henriksson | |
| 2006/0124897 | A1 * | 6/2006 | Shingai et al. | 252/299.01 |

FOREIGN PATENT DOCUMENTS

| | | | |
|---|---|---|---|
| DE | 44 07 855 | A1 | 8/1995 |
| DE | 10144983 | A1 | 7/2003 |
| DE | 69823425 | T2 | 5/2005 |
| FR | 2 818 787 | A1 | 6/2002 |
| JP | A 11 242087 | | 9/1999 |
| JP | T 2004 538480 | | 12/2004 |
| JP | 2005160759 | A | 6/2005 |
| JP | A 2005 160759 | | 6/2005 |

OTHER PUBLICATIONS

Communication from Japanese Patent office, pp. 1-6.

* cited by examiner

*Primary Examiner* — Quan-Zhen Wang
*Assistant Examiner* — Calvin C Ma

(57) ABSTRACT

There is described a display system which is used, in particular, in an industrial automation device. This display system has a first display panel which can be electrically operated and is transparent at least in parts and/or at times. The display system also has a second display panel, wherein the first display panel is positioned with respect to the second display panel in such a manner that the second display panel can be viewed through the first display panel. The second display panel is, in particular, a nameplate.

18 Claims, 2 Drawing Sheets

DISPLAY SYSTEM, IN PARTICULAR FOR AN INDUSTRIAL AUTOMATION DEVICE

CROSS REFERENCE TO RELATED APPLICATIONS

This application is the US National Stage of International Application No. PCT/EP2006/064962, filed Aug. 2, 2006 and claims the benefit thereof. The International Application claims the benefits of German application No. 10 2005 043 310.3 DE filed Sep. 12, 2005, both of the applications are incorporated by reference herein in their entirety.

FIELD OF INVENTION

The invention relates to a display system used for example for displaying a graphic, an alphabetic character and/or a numeric character. In this situation the display generally concerns a plurality of alphabetic characters and/or numeric characters. With the aid of a graphical display, a time of day or a value for example can be displayed in analog form by means of at least one pointer. The display also concerns for example a text or mathematical characters.

BACKGROUND OF INVENTION

Display systems are used for example in industrial automation devices. Industrial automation devices are for example devices for regulation and/or control purposes (a programmable logic controller PLC for example), a switched mode power supply, a power converter, a contactor etc. Such devices are used in particular in control engineering and drive engineering. The industrial automation devices are subject to an ever increasing extent to demands for compactness with enhanced functional capabilities and a growing interface framework. In conjunction with basic conditions such as "side-by-side mounting" and predefined connector assemblies or cable cross-sections for example, this leads to the problem that the space available on the front face of the device becomes ever less. In a control cabinet, industrial automation devices are positioned alongside one another for example on a rail. Only a top side, an underside and a front face of the industrial automation device are then available for connection of cables to the industrial automation device. If it should be easily possible to read information from the industrial automation device, without needing to disassemble the industrial automation device for example, then the industrial automation device has a display system which is situated in particular on the front face of the industrial automation device. Since easily accessible sides of the industrial automation device, such as in particular the front face, are however mostly too small to accommodate all the displays, the displays are either reduced in size, which impairs their readability, or displays are placed at positions on the industrial automation device which are difficult to access. If the industrial automation device has an identification plate for example, then in the absence of a better and more easily accessible space this identification plate is for example mounted on one side of the industrial automation device, which is provided so that in the installed state a further industrial automation device adjoins it at this side in the control cabinet. The identification plate as a passive form of a display system can consequently only be read prior to installation or after removal. In addition to the type and/or the serial number, the identification plate also carries a bar code for example. A display system which can be operated electrically is for example provided on the front face of the industrial automation component. Such display systems which can be operated electrically are for example LED displays, LCD displays, OLED displays, etc. These display systems which can be operated electrically have a display panel and if applicable also a control electronics unit for the display panel. An input unit is for example also associated with the display system which can be operated electrically, using keys for example. The input unit can however advantageously also be combined with the display system in the form of a touch-sensitive display panel (touch-screen).

Display panels, be they display panels which can be operated electrically, whereby these constitute active display panels, or also passive display panels (an identification plate for example), can only be miniaturized up to a certain limit if they are to remain capable of being read by a person without any auxiliary means. Displays, and also operating controls, must have a certain minimum size for ergonomic reasons.

If the space for optimum mounting of the display system or display systems (a display and an identification plate for example) is limited, then it has previously been necessary to accept compromises. One compromise is for example to mount the identification plate at a position on the industrial automation device which is difficult to access or also on another device, or also to reduce the size of the display panel, with the result that the clarity of the display suffers. A further known measure is to reduce the size of input keys on an input unit which is associated with the display system.

A display device is known from US 2004/0257317 A1, in which a liquid crystal display is arranged in front of a poster. The poster can be viewed through the liquid crystal display. Text can simultaneously be displayed on the liquid crystal display.

A hand-held unit is known from US 2005/0052341 A1, which has two display panels arranged behind one another, whereby the rear display panel can be viewed through the front display panel.

FR 2 818 787 A describes a display device in which graphics can be presented on a screen. An illumination source is arranged behind the screen. With the aid of the illumination, symbols and texts can be presented, which can be viewed from the front together with the graphic situated on the screen.

SUMMARY OF INVENTION

An object of the present invention is to set down an industrial automation device in which the display functionality is improved.

This object is achieved by an industrial automation device having the features described in an independent claim. Subclaims represent preferred embodiments.

According to the invention, an industrial automation device has a display system which has a first display panel, whereby the first display panel can be operated electrically and is at least partially and/or at times transparent. This first display panel corresponds for example to the display panel of a transparent LCD display or a transparent OLED display (TOLED). Furthermore, the display system according to the invention has a second, passive display panel, whereby the first display panel is positioned in such a manner with respect to the second display panel that the second display panel can be viewed through the first display panel. The first display panel and the second display panel are therefore positioned behind one another, whereby this positioning in particular affects the lines of sight in which both the first display panel and also the second display panel can be viewed simultaneously.

A display system according to the invention has a first display panel, whereby the first display panel can be operated electrically and is at least partially and/or at times transparent. This first display panel corresponds for example to the display panel of a transparent LCD display or a transparent OLED display (TOLED). Furthermore, the display system according to the invention has a second display panel, whereby the first display panel is positioned in such a manner with respect to the second display panel that the second display panel can be viewed through the first display panel. The first display panel and the second display panel are therefore positioned behind one another, whereby this positioning in particular affects the lines of sight in which both the first display panel and also the second display panel can be viewed simultaneously. The transparency of the first display panel in particular exists only partially as a rule during the display because the display is effected by a difference in contrast and depending on a positive display or on a negative display there are areas of the display panel which either exhibit a good transparency or also exhibit a reduced transparency. A reduced transparency can ultimately result in intransparency.

As a result of the inventive embodiment of the display system it is possible to accommodate two display panels in the same space of a piece of equipment, in particular of an industrial automation device. The equipment can however for example also be a cockpit for a motorcycle since in this case it is also necessary to utilize the small amount of available space to good advantage.

Since at least two display panels overlap in the case of the present display system, both can be viewed simultaneously and/or with a time lag. Simultaneous viewing is possible for example in the case when the displays do not overlap on the display panels, such that a good readability results. Furthermore, it is advantageous if for example the contrast or the color of the displays on the display panels differs, such that a good readability results from this. In a further embodiment, in order to read the second display panel the first display panel can for example be switched to transparent, such that a display is effected at times only by the second display panel and there is no display on the first display panel.

In a further embodiment of the display system the first display panel is connected to the second display panel. A connection can be configured as follows for example:

- both display panels are connected directly to one another
- both display panels are connected to one another by way of a mounting frame
- both display panels are connected to one another by way of a housing of a further device
- both display panels are connected to one another by way of spacer pieces
- both display panels are connected to one another by way of at least one further third display panel situated between them
- etc.

This connection is in particular a permanent connection, such that the position of the display panels relative to one another is fixed.

In a further embodiment of the display system according to the invention the second display panel is implemented as a passive display panel. A passive display panel does not change with regard to its display. It is therefore not possible to change displayed data by electrical means. Examples of passive display panels are listed in the following:

- a printed plate, whereby the plate is manufactured for example from a metal or a plastic
- an embossed plate, whereby a display is produced by the embossing of alphabetic characters for example
- a printed and embossed plate
- a printed adhesive label
- a printed surface
- a painted surface
- etc.

The passive display panel is an extremely simple and cost-effective technology for the representation of for example: images, text, numbers etc.

According to a further embodiment of the display system, this has a third display panel, whereby the third display panel is positioned between the first display panel and the second display panel. The third display panel for example can be operated electrically, whereby like the first display panel it can additionally exhibit an operating state which makes it possible to influence the transparency at least partially and/or at times. It is advantageous if the third display panel can be made nontransparent at least partially and/or at times or only to a limited extent. If the third display panel or also a further display panel between the first and the second display panel is intransparent or if this forms a dark background for the first display panel, this first display panel can be better read. If the second display panel is intended to be easily read by a person, then the third display panel or a further display panel is made transparent between the first and the second.

The readability of the display panels can also be improved by equipping the display system with a light source which can be operated electrically. In this situation, the better readability concerns the second display panel in particular. In a further advantageous embodiment a display panel, in particular the first display panel, exhibits a property which concerns the self-illumination of the display panel. OLEDs are one example of self-illuminating displays.

The display system according to the invention is advantageously mounted on an industrial automation device. This also includes the fact that the display system is integrated into the industrial automation device. The trend towards an ever smaller construction method can be observed particularly in the case of industrial automation devices. As a result, the surface area which can be used for representing and displaying information is reduced in size. By using the display system according to the invention for the industrial automation device (this is for example a PLC controller, a power converter, a CNC controller, a power supply unit, a regulation facility, . . . ) it is then possible to utilize a surface area of the industrial automation device in twofold fashion for displaying information. The display can thus advantageously for example be made larger such that it can be read more easily and/or from a greater distance. If an identification plate for the industrial automation device is now used as a second display panel, the identification plate can also be easily read. In order to improve the readability, the first display panel must be switched to transparent.

According to the above description the invention consequently also relates to an industrial automation device which has a display system whereby the display system has a first display panel whereby the first display panel can be operated electrically and is at least partially and/or at times transparent, whereby the display system also has a second display panel, whereby the first display panel is positioned in such a manner with respect to the second display panel that the second display panel can be viewed through the first display panel. The display system can furthermore be implemented in the embodiments described above.

In addition, the invention relates to a method for operating a display system, whereby the display system in particular has an embodiment of the forms described above. The display system has a first display panel, whereby this can be operated electrically and is at least partially and/or at times transparent and it has a second display panel, whereby the first display panel is positioned in such a manner with respect to the second display panel that the second display panel can be viewed through the first display panel by a person, whereby the first display panel is operated in an at least partially transparent state. If the display system has a third display panel, whereby the third display panel is positioned between the first display panel and the second display panel, whereby the third display panel can be operated electrically and is at least partially and/or at times nontransparent, the third display panel is for example controlled electrically in such a manner that it becomes more opaque and maintains this state. The second display panel is hidden as a result. This enables better viewing of the first display panel or of the display panel which is situated in front of the third display panel in the viewing direction. The method can also be used in the case of a display system for an industrial automation device. In this case, it has the advantage for example that when the industrial automation device is switched off the display system is also switched off or can be switched off and in this state, for example during installation of the industrial automation device, the identification plate can be easily read as a second display panel behind for example an OLED display panel and the industrial automation device can thus be easily identified. When the industrial automation device is operating, in order to read the identification plate it is then for example possible to deactivate, or make transparent, the first display panel, which can be controlled electrically.

BRIEF DESCRIPTION OF THE DRAWINGS

Examples of the prior art and further advantages and details of the invention emerge from the following description of an embodiment. In the drawings.

DETAILED DESCRIPTION OF INVENTION

Figure 1:
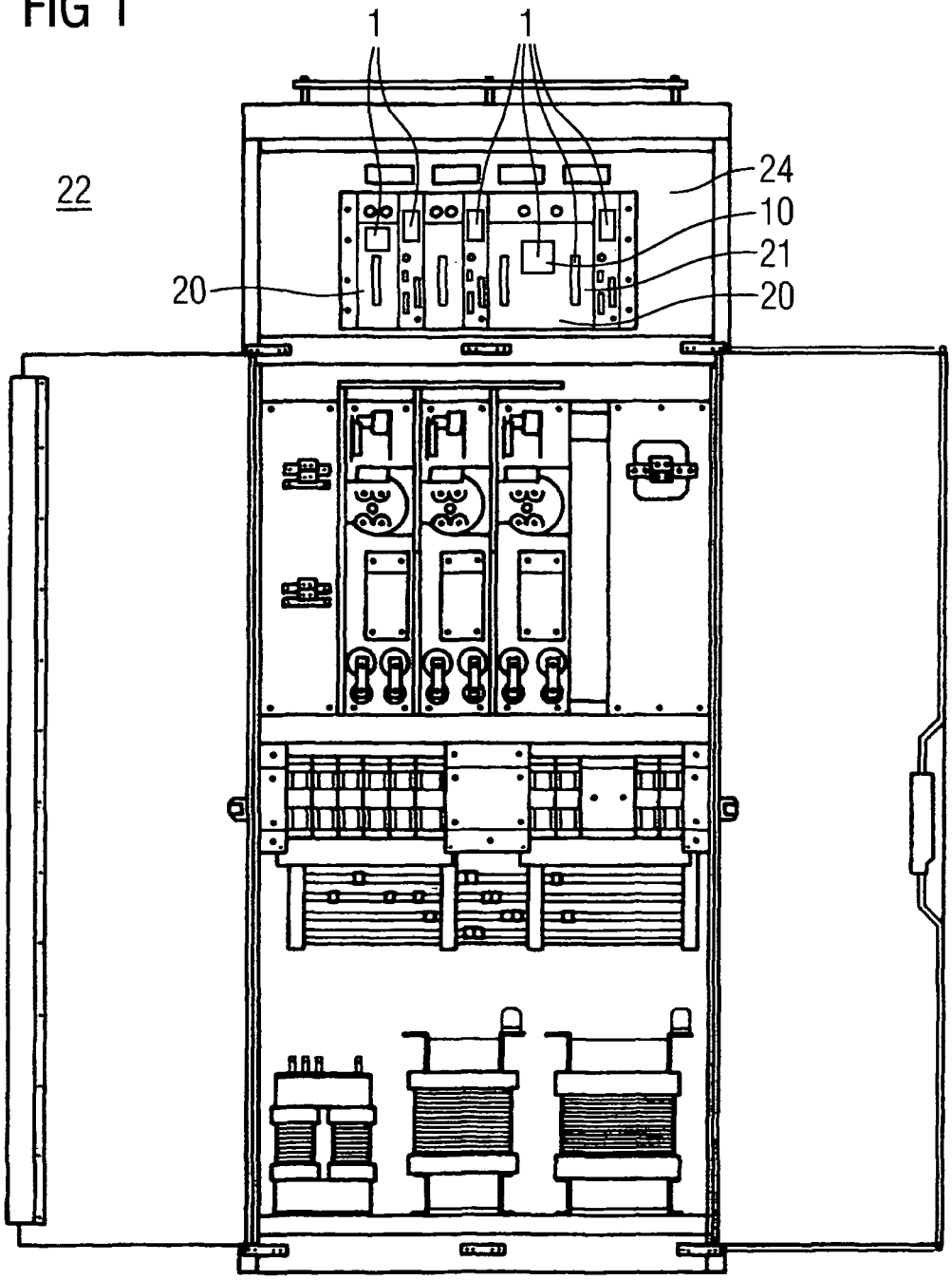
FIG. 1 shows a control cabinet.

The illustration according to FIG. 1 shows a control cabinet 22. The control cabinet 22 has a module rack 24. Different modules 20 are inserted in the module rack 24. One module 20 is an example of an industrial automation device. The modules 20 have a front face 21. A display system 1 is located on the front face 21. The display systems 1 have display panels 10.

The problem of lack of space affecting an industrial automation device can therefore be solved according to the invention by combining the functions of the readability of an identification plate and the readability of an operating and display element. For this purpose, a self-illuminating (OLED) or reflective (LCD) display for example is used in conjunction with a touch-screen for example. This display system replaces for example mechanical control knobs and enables a manageability appropriate to the operator control actions through corresponding configuration of (soft) input buttons. In the case of warnings and/or alarms from the industrial automation device, these can also be displayed by way of the display system 1. In order to also have the information from the identification plate available in the switched-off state, for example when stored, at service centers etc., the identification plate (if applicable, on a special carrier which is not shown) is advantageously mounted beneath the entire display area of the display panel 10. If no operator control action is performed (no contact on the touch-screen), then the display of the display panel 10 switches off. The same state results if this component, in other words the display panel 10, is free of voltage. The displays used appear transparent in particular in the currentless state and the identification plate is readable. When using OLEDs, a transparency between approximately 70% to 85% can be assumed.

Figure 2:
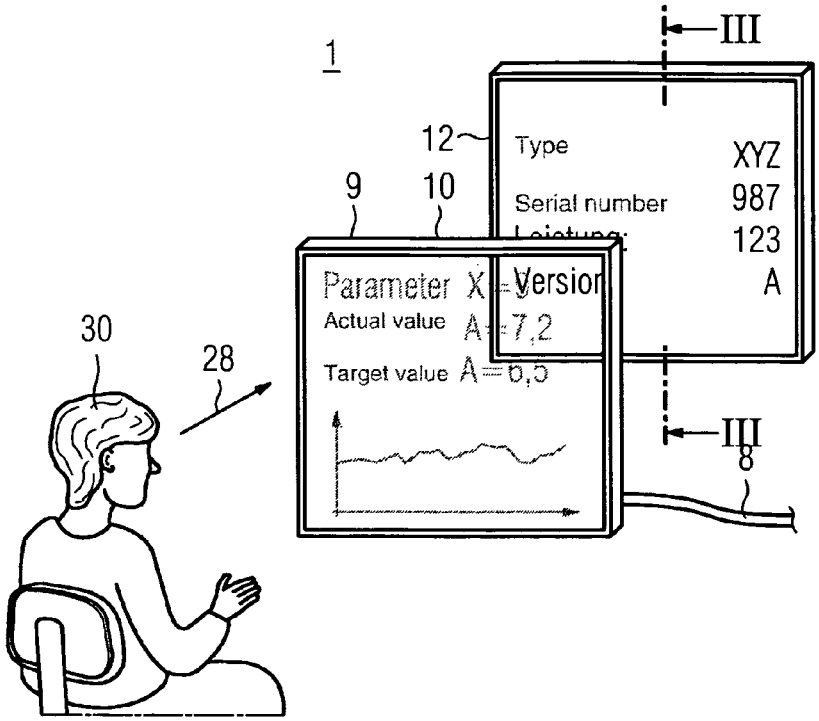
FIGS. 2 to 6 show different display systems.

The illustration according to FIG. 2 shows a display system 1. The display system 1 has a first display panel 10 and a second display panel 12. The display panels 10, 12 have a frame 9. On the first display panel 10, which can be operated electrically by way of the cable 8, the following information is displayed:

Parameter X=9

Actual value A=7.2

Rated value A=6.5

<graphic Z>

In order to display this information, an LCD display for example is used for the display panel.

In addition to the first display panel 10, the illustration according to FIG. 2 also shows a second display panel 12. The second display panel 12 is for example implemented as an embossed and printed identification plate, whereby the following information is displayed by the display panel 12:

Type: XYZ

Serial number: 987

Power: 123

Version: A

For a viewer 30 having the line of sight 28, the displays of the display panels 10 and 12 overlap. This overlap is also indicated in FIG. 2 by the fact that the display on the display panel 10 is represented in dashed lines. A section plane III is illustrated in the illustration according to FIG. 2. Sections in this section plane are illustrated in FIGS. 3 to 6, whereby the illustrations shown in these figures are concerned with different construction variants of display systems.

Figure 3:
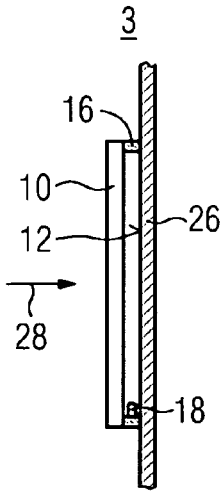

The illustration according to FIG. 3 shows a section through a display system 3, whereby the section is taken in a plane according to the illustration in FIG. 2, whereby the display system 3 has a first display panel 10 and a second display panel 12. The first display panel 10 is spaced from the display panel 12 by means of spacer pieces 16. An LED 18 is arranged between the display panel 10 and the display panel 12 as an illumination facility which can be operated electrically. The display panel 12 is an image which is applied on a housing 26. The housing 26 is for example the housing of an industrial automation device.

Figure 4:
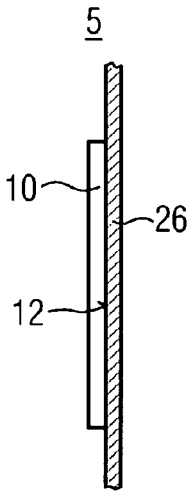

The illustration according to FIG. 4 shows a section through a further display system 5, whereby the section is taken in a plane according to the illustration in FIG. 2, whereby the display system 5 has a first display panel 10 and a second display panel 12. The first display panel 10 is now applied directly on the housing 26 without the use of spacer pieces.

Figure 5:
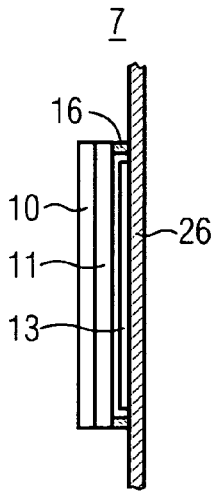

The illustration according to FIG. 5 shows a section through a further display system 7, whereby the section is taken in a plane according to the illustration in FIG. 2, whereby the display system 7 has a first display panel 10, a third display panel 11 and a second display panel 13. The third display panel 11 is positioned between the first and the second. The third display panel 11 has in particular the function of forming a dark background for the first display panel 10 in order to improve the readability of the latter. The display panel 11 is spaced from the display panel 13 by means of spacer pieces 16. The second display panel 13 is implemented as an identification plate which is positioned on the housing 26.

Figure 6:
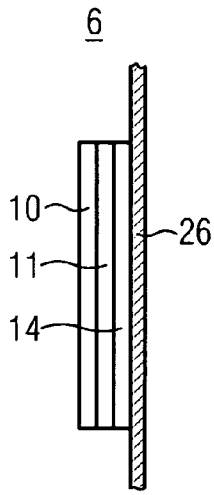

The illustration according to FIG. 6 shows a section through a further display system 6, whereby the section is taken in a plane according to the illustration in FIG. 2, whereby the display system 6 has a first display panel 10, a third display panel 11 and a second display panel 14. The third display panel 11 is positioned between the first and the second. The second display panel 14 is, like the display panels one 10 and three 11, a display panel which can be operated electrically. By this means the flexibility of the display options is increased. In this situation, the display concerns in particular data which concern an industrial automation component, this having a housing 26.

The invention claimed is:

1. A display system, comprising:

a first display panel electrically operable and selectively operable in a partially or fully transparent state, wherein the first display panel functions as an operating and display element for an industrial automation device to provide for operator control and information display in its partially transparent state; and a second display panel, wherein the second display panel is a passive display panel comprising printed information thereon that does not change with regard to its display, the second display panel positioned in such a manner with respect to the first display panel that the second display panel can be viewed partially or fully through the first display panel depending on the transparency state of the first display panel, wherein, when operator control action is performed on the operating and display element, the first display panel functions as the operating and display element in its partially transparent state to provide for operator control and information display, and wherein, if no operator control action is performed on the operating and display element, the first display panel switches to its fully transparent state thereby allowing viewing of the printed information on the second display panel.

2. The display system as claimed in claim 1, wherein the second display panel is a nameplate for the industrial automation device.

3. The display system as claimed in one of claim 2, wherein the display system has a third display panel, wherein the third display panel is electrically operated and is positioned between the first display panel and the second display panel, wherein the third display panel is selectively transparent or nontransparent, allowing for readability of the second display panel when transparent and providing an opaque background for readability of the operating and display element of the first display panel when nontransparent.

4. The display system as claimed in one of claim 1, wherein the display system has a third display panel, wherein the third display panel is electrically operated and is positioned between the first display panel and the second display panel, wherein the third display panel is selectively transparent or nontransparent, wherein the third display panel is positioned in such a manner with respect to the first and second display panel that, depending on the transparency state of the third display panel, the second display panel can be viewed through the first and third display panel when transparent and is hidden from view when nontransparent.

5. The display system as claimed in claim 1, further comprising a light source for self-illuminating the first display panel.

6. The display system as claimed in claim 1, further comprising a light source for illuminating the second display.

7. The display system as claimed in claim 1, wherein the display system is mounted on the industrial automation device such that the operating and display element replaces mechanical control knobs for operator control and information display.

8. The display system as claimed in claim 1, wherein the display system is mounted on the industrial automation device such that the operating and display element replaces mechanical control knobs with a touch-screen for operator control and information display.

9. The display system as claimed in claim 1, wherein the second display panel displays a Serial Number and a Type for the industrial automation device.

10. An industrial automation device, comprising:

a display system, wherein the display system has overlapping display panels comprising:

a first display panel comprising an operating and display element for an industrial automation device to provide for operator control and information display, a second, passive display panel comprising printed information thereon that does not change with regard to its display, and a third display panel, wherein the first display panel is operated electrically and is selectively operable in a partially or fully transparent state, wherein the first display panel functions as the operating and display element for the industrial automation device to provide for operator control and information display in its partially transparent state, wherein the first display panel is positioned in such a manner with respect to the second display panel that the second display panel can be viewed partially or fully through the first display panel depending on the transparency state of the first display panel, wherein, when operator control action is performed on the operating and display element, the first display panel functions as the operating and display element in its partially transparent state to provide for operator control and information display, and wherein, if no operator control action is performed on the operating and display element, the first display panel switches to its fully transparent state, thereby allowing viewing of the printed information on the second display panel, and wherein the third display panel is positioned between the first display panel and the second display panel, wherein the third display panel is electrically operable and is selectively transparent or nontransparent, such that the second display panel can be viewed through the first and third display panel when transparent and is hidden from view when nontransparent.

11. The industrial automation device as claimed in claim 10, wherein the first display panel is connected to the second display panel.

12. The industrial automation device as claimed in claim 10, wherein the display system has an electrical light source for self-illuminating the first display panel.

13. The industrial automation device as claimed in claim 10, wherein the display system has an electrical light source for illuminating the second display panel.

14. The industrial automation device as claimed in claim 10, wherein the second display panel is an identification plate for the industrial automation device.

15. A method for operating a display system, comprising:

providing a first display panel comprising an operating and display element for an industrial automation device to provide for operator control and information display;

operating the first display panel electrically, wherein the first display panel is selectively operable in a partially or a fully transparent state, wherein the first display panel functions as the operating and display element for the industrial automation device to provide for operator control and information display in its partially transparent state; and providing a second display panel comprising a passive display panel having printed information thereon that does not change with regard to its display, wherein the first display panel is positioned in such a manner with respect to second display panel that the second display panel is partially or fully viewed through the first display panel, depending on the transparency state of the first display panel, and wherein, when operator control action is performed on the operating and display element, the first display panel functions as the operating and display element in its partially transparent state to provide for operator control and information display, and wherein, if no operator control action is performed on the operating and display element, the first display panel switches to its fully transparent state, thereby allowing viewing of the printed information on the second display panel.

16. The method as claimed in claim 15, further comprising:

providing a third display panel, wherein the third display panel is positioned between the first display panel and the second display panel, and selectively operating the third display panel in a transparent or nontransparent state, whereby the second display panel is viewable through the first and third display panel when transparent and is hidden by the third display panel when nontransparent.

17. The method as claimed in claim 16, wherein the third display panel when in the nontransparent state, the second display panel is hidden by the third display panel and the first display panel has an improved readability with the third display panel providing an opaque background therefor.

18. The method as claimed in claim 15, further comprising:

providing a third display panel, wherein the third display panel is positioned between the first display panel and the second display panel, and selectively operating the third display panel at times nontransparent, wherein the second display panel is hidden by the third display panel and the first display panel has an improved readability when nontransparent providing an opaque background therefor.

* * * * *